US011047611B2

(12) United States Patent
Eom et al.

(10) Patent No.: US 11,047,611 B2
(45) Date of Patent: Jun. 29, 2021

(54) REFRIGERATOR

(71) Applicant: Samsung Electronics Co., Ltd, Suwon-si (KR)

(72) Inventors: Tae-In Eom, Suwon-si (KR); Hyun Uk Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/690,056

(22) Filed: Nov. 20, 2019

(65) Prior Publication Data

US 2020/0158419 A1 May 21, 2020

(30) Foreign Application Priority Data

Nov. 20, 2018 (KR) ..... 10-2018-0143133

(51) Int. Cl.
*F25D 23/02* (2006.01)
*F25D 25/02* (2006.01)

(52) U.S. Cl.
CPC ..... *F25D 23/028* (2013.01); *F25D 25/025* (2013.01)

(58) Field of Classification Search
CPC ..... F25D 23/00; F25D 23/02; F25D 23/028; F25D 25/021; F25D 25/022; F25D 25/025
USPC ..... 312/401, 404, 405, 405.1
See application file for complete search history.

(56) References Cited

U.S. PATENT DOCUMENTS 8,322,805 B2 12/2012 Kwon et al.
8,851,589 B2 10/2014 Gwak
8,944,534 B2 2/2015 Lim
9,285,155 B2 3/2016 Yoo et al.
9,816,746 B1 11/2017 Haney et al.
9,879,901 B2 1/2018 Lim
9,939,192 B2 4/2018 Yang et al.
10,113,789 B2 10/2018 Yu et al.
10,203,152 B2 2/2019 Yang et al.
(Continued)

FOREIGN PATENT DOCUMENTS

CN 105333669 B 2/2018
EP 3217130 A1 9/2017
EP 3258196 A2 12/2017
(Continued)

OTHER PUBLICATIONS

European Search Report dated Apr. 1, 2020 in connection with European Patent Application No. 19 21 0332, 11 pages.
(Continued)

*Primary Examiner* — James O Hansen

(57) ABSTRACT

A refrigerator capable of allowing a storage guard to be automatically pulled out when a door is opened. The refrigerator includes a body, a first door arranged in front of the body including an opening, and a second door arranged in front of the first door, configured to open and close the opening of the first door. The refrigerator includes a storage guard configured to be pulled out in front of the first door and inserted into the rear of the first door, and mounted to the first door, and a storage guard mover configured to pull out the storage guard to the front of the first door in response to opening of the second door at a predetermined angle or more, and to insert the storage guard into the rear of the first door in response to opening of the second door less than the predetermined angle.

19 Claims, 11 Drawing Sheets

(56) References Cited

U.S. PATENT DOCUMENTS

| | | | | |
|---|---|---|---|---|
| 2014/0285082 | A1 | 9/2014 | Choi et al. | |
| 2016/0273825 | A1* | 9/2016 | Lim | F25D 23/067 |

FOREIGN PATENT DOCUMENTS

| | | | |
|---|---|---|---|
| KR | 10-1307681 | B1 | 9/2013 |
| KR | 10-2013-0117313 | A | 10/2013 |
| KR | 10-2014-0116620 | A | 10/2014 |
| KR | 10-1704817 | B1 | 2/2017 |
| KR | 10-1708698 | B1 | 2/2017 |
| KR | 10-1741392 | B1 | 5/2017 |
| KR | 10-1844072 | B1 | 5/2018 |
| KR | 10-1860713 | B1 | 5/2018 |
| KR | 10-1871266 | B1 | 6/2018 |

OTHER PUBLICATIONS

International Search Report dated Mar. 24, 2020 in connection with International Patent Application No. PCT/KR2019/015863, 3 pages.

* cited by examiner

REFRIGERATOR

CROSS-REFERENCE TO RELATED APPLICATION

This application is based on and claims priority under 35 U.S.C. § 119 to Korean Patent Application No. 10-2018-0143133 filed on Nov. 20, 2018 in the Korean Intellectual Property Office, the disclosure of which is incorporated by reference herein in its entirety.

BACKGROUND

1. Field

The disclosure relates to a refrigerator, and more particularly, to a refrigerator including a storage guard capable of being automatically pulled out in response to opening of a door.

2. Description of Related Art

In general, a refrigerator is a device that provides cold air generated by a refrigeration cycle composed of a compressor, a condenser, an expansion valve, and an evaporator, to lower a temperature of an inside of the device, thereby freezing or refrigerating food The refrigerator may include a storage guard provided to store food. For example, the storage guard may be installed in a door of the refrigerator.

The storage guard may be configured to be pulled out in a forward direction of the refrigerator so that a user may easily access the storage guard. However, it may be inconvenient for the user to manually pull out the storage guard after opening the door.

SUMMARY

Therefore, it is an aspect of the disclosure to provide a refrigerator including a storage guard mover capable of automatically pulling out or inserting a storage guard in response to opening or closing of a door.

It is another aspect of the disclosure to provide a refrigerator including a storage guard mover capable of pulling out a storage guard in response of opening of a door at a predetermined angle or more.

It is another aspect of the disclosure to provide a refrigerator capable of opening and closing of a door and pulling out and inserting a storage guard without interference with each other.

Additional aspects of the disclosure will be set forth in part in the description which follows and, in part, will be obvious from the description, or may be learned by practice of the disclosure.

In accordance with an aspect of the disclosure, a refrigerator includes a body including a storage compartment, a first door arranged in front of the body and including an opening, a second door arranged in front of the first door and configured to open and close the opening of the first door, a storage guard configured to be pulled out in front of the first door and inserted into the rear of the first door, and mounted to the first door, and a storage guard mover configured to pull out the storage guard to the front of the first door in response to opening of the second door at a predetermined angle or more, and configured to insert the storage guard into the rear of the first door in response to opening of the second door at an angle less than the predetermined angle. The storage guard mover includes a pusher provided in the second door and configured to be rotated together with the second door, and a guide configured to be moved in a first direction to pull out the storage guard from the first door or to be moved in a second direction opposite to the first direction to insert the storage guard into the first door, and the guide has a fixed position when the pusher is rotated at an angle less than the predetermined angle.

The guide may include a contact surface provided to be in contact with the pusher and the contact surface may include a first section in which a position of the guide is fixed when the pusher is rotated at an angle less than the predetermined angle, and a second section in which the guide is moved in the first direction or the second direction when the pusher is rotated at the predetermined angle or more.

The first section may include a curved surface having an arc of a circle, and the second section may include a plane having a straight shape.

The first section may have an arc of a circle having a radius corresponding to a distance from a rotation axis of the pusher to an end portion of the pusher.

The storage guard mover may further include a slider configured to be moved in the second direction or the first direction when the guide is moved in the first direction or the second direction.

The storage guard mover may further include a gear disposed between the guide and the slider, and when any one of the guide and the slider is moved, the gear may transmit power to move the other of the guide and the slider.

The storage guard mover may further include a link rotatably coupled to the slider and configured to be rotated when the slider is moved in the first direction or the second direction.

A rotation direction of the link when the slider is moved in the first direction and a rotation direction of the link when the slider is moved in the second direction may be opposite to each other.

The storage guard mover may further include an elastic member configured to accumulate an elastic force when the second door is closed, and configured to provide the elastic force to move the slider when the second door is opened at the predetermined angle or more.

The refrigerator may further include a bracket fixed to the first door to support the storage guard.

The link may further include a shaft corresponding to the rotation axis of the link, and the shaft may be connected to the bracket to be rotatable relative to the bracket.

The storage guard mover may further include an elastic member case in which the elastic member is placed and configured to be moved in the first direction or the second direction by the elastic force of the elastic member.

One end of the elastic member may be connected to the bracket, and the other end of the elastic member may be connected to the elastic member case.

Each of the guide and the slider may include a rack gear configured to engage with the gear.

In accordance with another aspect of the disclosure, a refrigerator includes a body including a storage compartment, an inner door arranged in front of the body and including an opening, an outer door arranged in front of the inner door and configured to open and close the opening of the inner door, a storage guard configured to be pulled out from the inner door in a first direction and inserted into the inner door in a second direction opposite to the first direction, and mounted to the inner door, a pusher configured to be rotated together with the outer door, a guide configured to be moved in the first direction or the second direction according to the rotation of the pusher, a slider configured to be moved in the second direction or the first direction when the guide is moved in the first direction or the second direction, and a link connected to the slider so as to move the storage guard.

The guide may include a contact surface provided to be in contact with the pusher, and the contact surface may include a first section in which a position of the guide is fixed when the pusher is rotated at an angle less than a predetermined angle, and a second section in which the guide is moved in the first direction or the second direction when the pusher is rotated at the predetermined angle or more.

The first section may have an arc of a circle having a radius corresponding to a distance from a rotation axis of the pusher to an end portion of the pusher.

The storage guard mover may further include an elastic member configured to accumulate an elastic force when the outer door is closed, and configured to provide the elastic force to move the slider to the second direction when the outer door is opened at the predetermined angle or more The storage guard mover may further include a gear disposed between the guide and the slider, and when any one of the guide and the slider is moved, the gear may transmit power to move the other of the guide and the slider.

In accordance with another aspect of the disclosure, a refrigerator includes a body including a storage compartment, a door coupled to the body to open and close the storage compartment, a storage guard arranged in the storage compartment, and a storage guard mover configured to pull out the storage guard from the storage compartment or insert the storage guard into the storage compartment in response to opening and closing of the door. The storage guard mover includes a pusher configured to be rotated together with the door, and a guide configured to be moved in a first direction when the door is opened and configured to be moved in a second direction opposite to the first direction when the door is closed, and the guide has a fixed position when the door is rotated at an angle less than a predetermined angle from a closed state.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
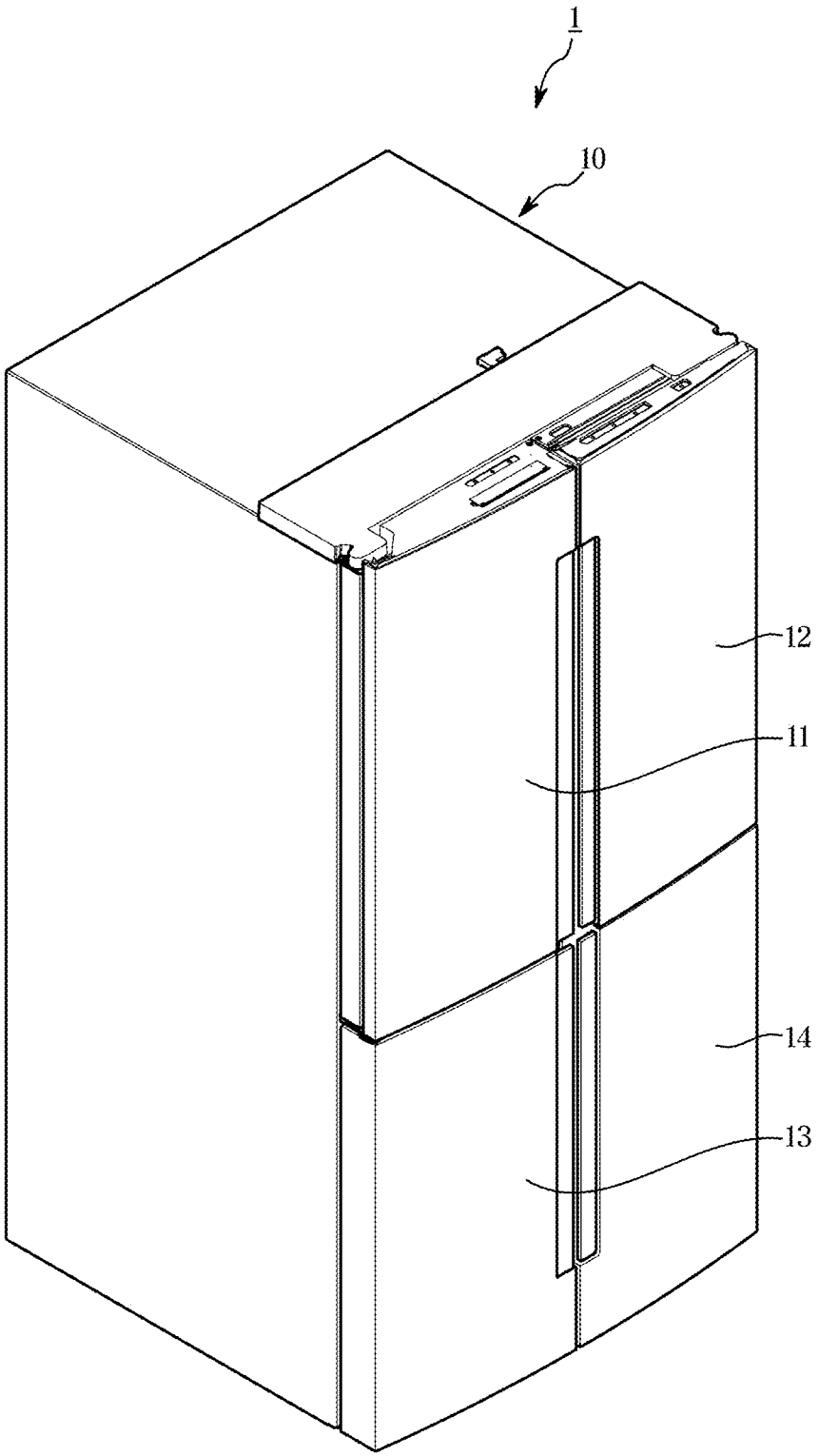
FIG. 1 illustrates a perspective view of a refrigerator according to an embodiment of the disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the disclosure and configurations shown in the drawings are merely examples of the embodiments of the disclosure, and may be modified in various different ways at the time of filing of the present application to replace the embodiments and drawings of the disclosure.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element.

Hereinafter with reference to the accompanying drawings an embodiment according to the disclosure will be described in detail. Hereinafter a first door may represent an inner door. A second door may represent an outer door. In addition, a first direction may represent the front of the refrigerator, and a second direction may represent the rear of the refrigerator.

Figure 2:
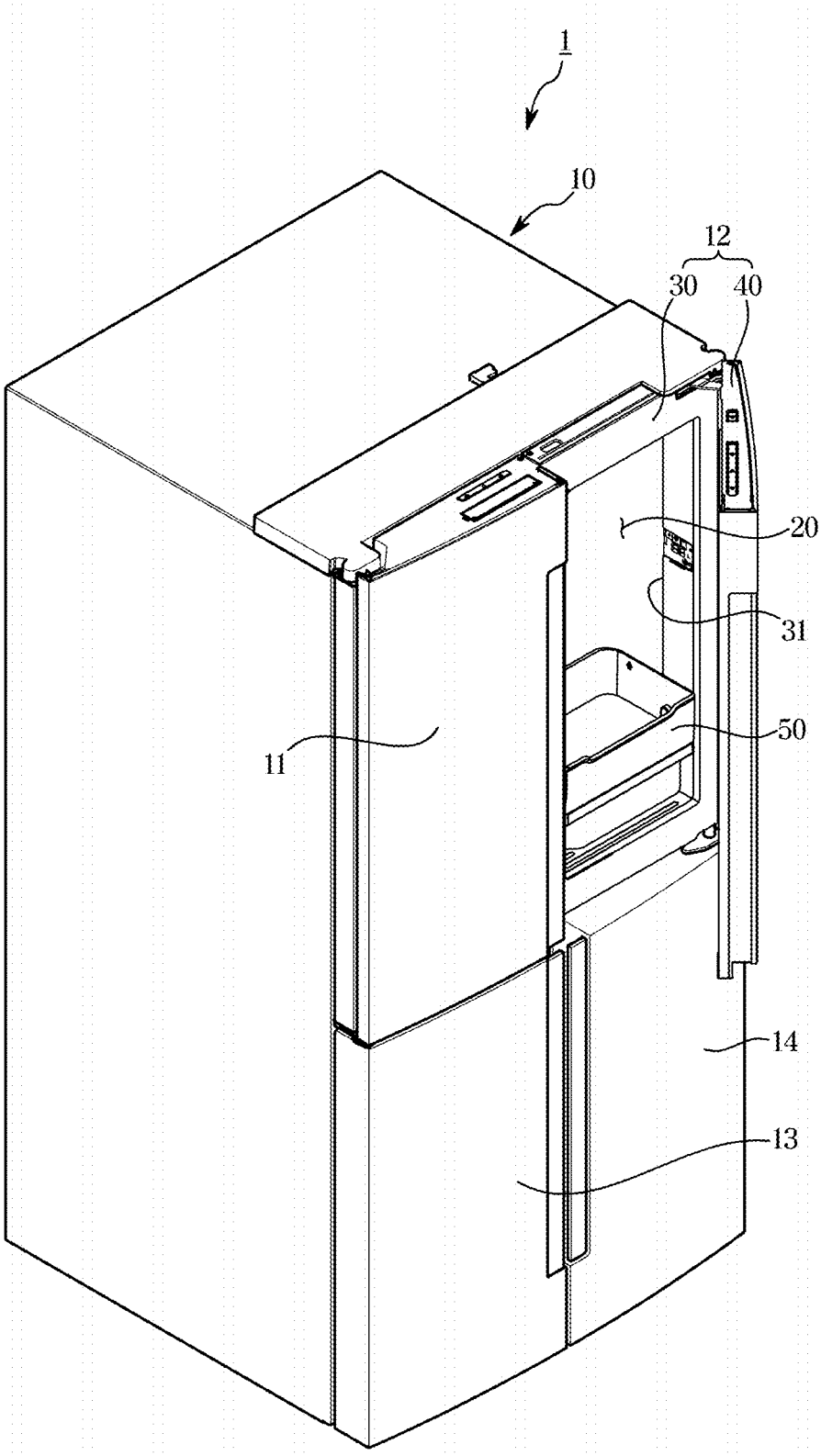
FIG. 2 illustrates a perspective view of the refrigerator being opened at an angle less than a predetermined angle, in the refrigerator according to an embodiment of the disclosure.
Figure 3:
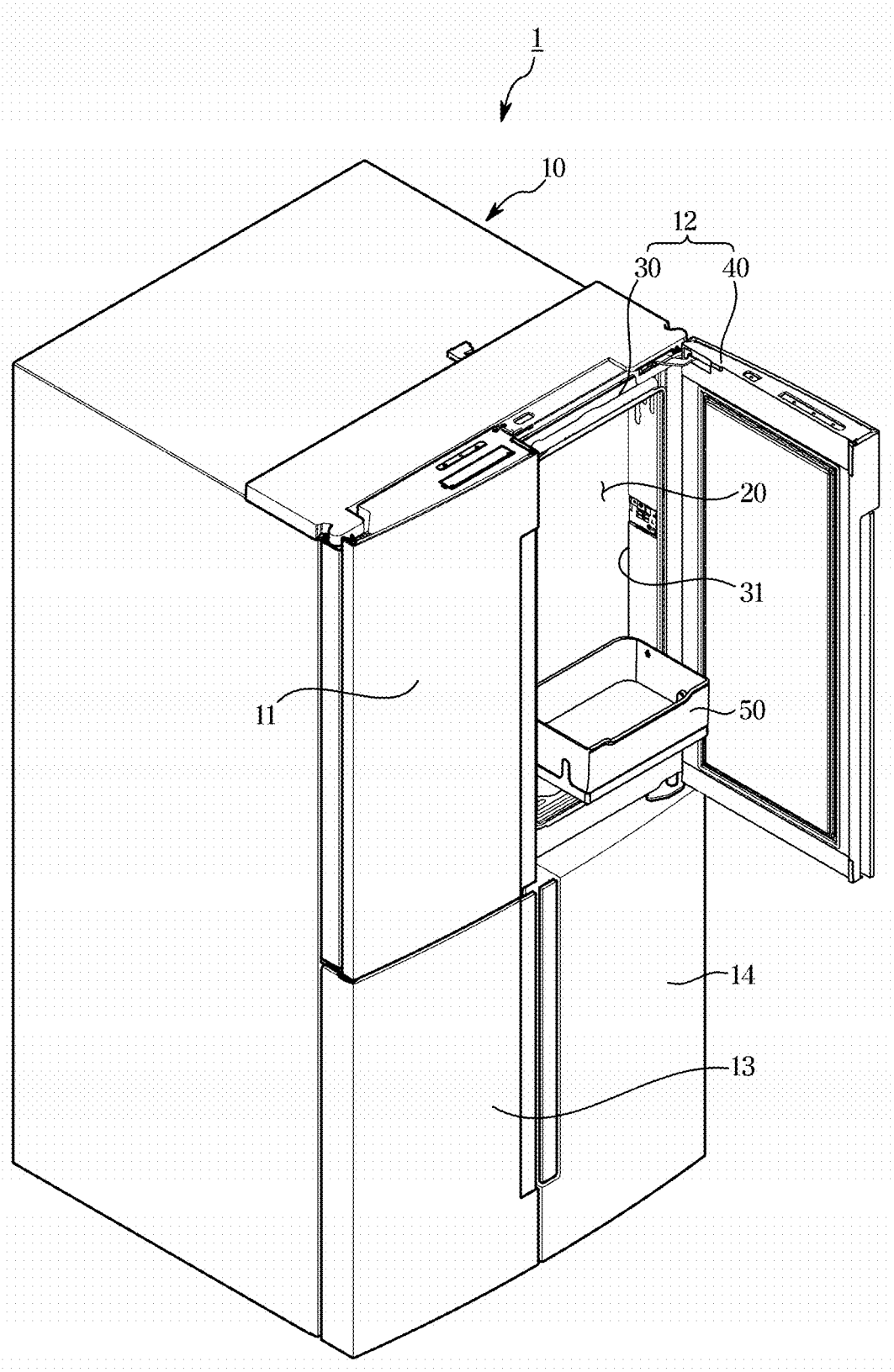
FIG. 3 illustrates a perspective view of the refrigerator being opened at the predetermined angle or more, in the refrigerator according to an embodiment of the disclosure.

FIG. 1 illustrates a perspective view of a refrigerator according to an embodiment of the disclosure. FIG. 2 illustrates a perspective view of the refrigerator being opened at an angle less than a predetermined angle, in the refrigerator according to an embodiment of the disclosure. FIG. 3 illustrates a perspective view of the refrigerator being opened at the predetermined angle or more, in the refrigerator according to an embodiment of the disclosure.

Referring to FIG. 1, in a refrigerator 1 according to an embodiment of the disclosure, a storage compartment may be provided in an upper portion and a lower portion of a body 10, respectively. The refrigerator 1 may include a plurality of doors 11 and 12 configured to open and close an upper storage compartment and a pair of doors 13 and 14 configured to open and close a lower storage compartment. The upper storage compartment may be provided as a refrigerating compartment, and the lower storage compartment may be provided as a freezing compartment. However, this is merely an example, and the arrangement of the refrigerator door or the arrangement of the storage compartment is not limited thereto.

Referring to FIGS. 2 and 3, the refrigerator 1 may include the body 10 including a storage compartment 20, a first door 30 arranged in front of the body 10 and provided with an opening 31, and a second door 40 arranged in front of the first door 30 and configured to open and close the opening 31 of the first door 30.

The first door 30 may be rotatably coupled to the body 10. The first door 30 may be configured to open and close a part of the storage compartment 20.

The second door 40 may be rotatably coupled to the body 10. The second door 40 may be arranged in front of the first door 30. The second door 40 may be configured to open and close the opening 31 of the first door 30. The second door 40 may be configured to open and close the opening 31 when the first door 30 is closed. A user may access a storage guard 50 of the first door 30 by opening only the second door 40. Through this, it is possible to reduce the leakage of cold air from the storage compartment 20 and to increase the energy efficiency of the refrigerator.

The storage guard 50 may be mounted to the first door 30. The storage guard 50 may be mounted to the first door 30 to cross the opening 31. The storage guard 50 may be provided to store food. The storage guard 50 may include a plurality of storage guards. The plurality of storage guards may be arranged side by side in the vertical direction on the first door 30.

In general, a storage guard may be fixed to the inside of a first door or a body. When the storage guard is fixed to the inside of the first door or the body, it may be inconvenient for a user to access the storage guard. In order to improve this, the storage guard may be configured to be pulled out or inserted into. However, it may still be inconvenient because the user has to manually pull out or insert the storage guard.

According to the disclosure, the storage guard 50 may be configured to be pulled out in front of the first door 30 or inserted into the rear of the first door 30. Particularly, according to the disclosure, the storage guard 50 may be automatically pulled out in front of the first door 30 in response to opening of the second door 40, and automatically inserted into the rear side of the first door 30 in response to closing of the second door 40. Accordingly, access to the storage guard is convenient, and the usability of the refrigerator may be improved.

According to the disclosure, the storage guard 50 may be configured to be pulled out in front of the first door 30 in response to opening of the second door 40 at a predetermined angle or more. Referring to FIG. 2, when the second door 40 is opened at an angle less than the predetermined angle, the storage guard 50 may not be pulled out in front of the first door 30. Referring to FIG. 3, in response to opening of the second door 40 at the predetermined angle or more, the storage guard 50 may be pulled out in front of the first door 30.

According to the disclosure, because the storage guard 50 is not pulled out until the second door 40 is opened at a predetermined angle or more, the pull out of the storage guard 50 may be not interfered by the opening of the second door 40 even if the second door 40 is suddenly opened. Further, even if the second door 40 is suddenly closed, the insertion of the storage guard 50 may be not interfered by the closing of the second door 40.

Figure 4:
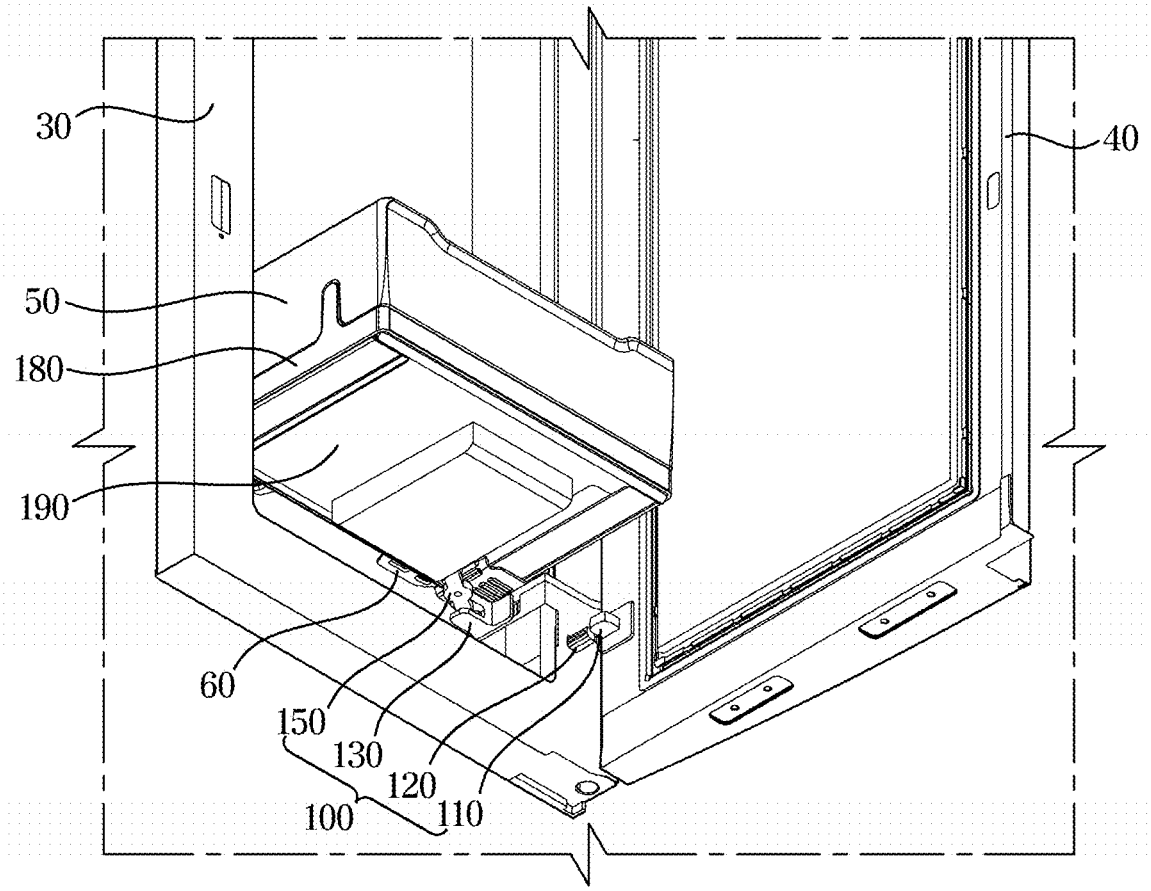
FIG. 4 illustrates a bottom perspective view of a refrigerator door according to an embodiment of the disclosure.
Figure 5:
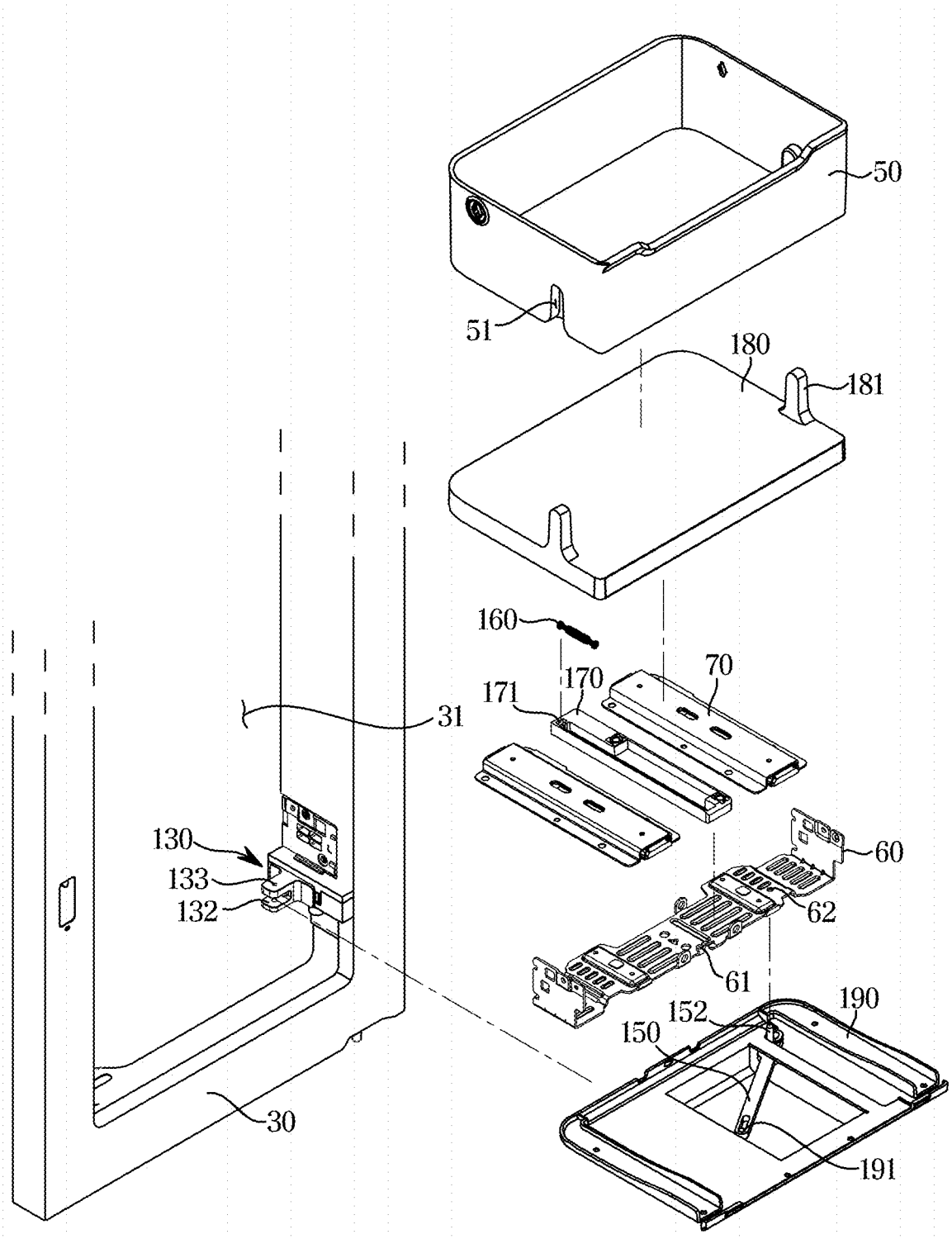
FIG. 5 illustrates an exploded perspective view of the refrigerator door according to an embodiment of the disclosure.

FIG. 4 illustrates a bottom perspective view of a refrigerator door according to an embodiment of the disclosure. FIG. 5 illustrates an exploded perspective view of the refrigerator door according to an embodiment of the disclosure.

Hereinafter an internal structure of the refrigerator door according to an embodiment of the disclosure will be briefly described with reference to FIGS. 4 and 5.

The refrigerator 1 may include a storage guard mover 100 configured to pull out or insert into the storage guard 50 in response to opening and closing of the second door 40.

Referring to FIG. 4, the storage guard mover 100 may include a pusher 110 installed on the second door 40 and configured to be rotatable together with the second door 40, and a guide 120 installed on the first door 30 and configured to be moved back and forth according to the rotation of the pusher 110.

When the guide 120 is moved forward, the storage guard 50 may be pulled out in front of the first door 30. When the guide 120 is moved forward and then moved backward, the storage guard 50 may be inserted into the first door 30. A detailed description of the pull out and the insertion of the storage guard 50 according to the movement of the guide 120 will be described later.

The storage guard mover 100 may include a link 150 configured to be rotated according to the movement of the guide 120. The link 150 may include a link hole 153 provided at one side of the link 150. A protrusion 191 of a lower support case 190 to be described later may be inserted into the link hole 153.

Referring to FIG. 5, the storage guard mover 100 may include a slider 130 configured to be moved backward when the guide 120 is moved forward, and configured to be moved forward when the guide 120 is moved backward. The slider 130 may be installed in the first door 30. The link 150 may be rotatably coupled to the slider 130. The slider 130 may include a link coupler 132 to which the link 150 is coupled.

The refrigerator 1 may include a bracket 60 fixed to the opening 31 of the first door 30. The bracket 60 may include a second elastic member fixer 61 configured to fix the other end of the elastic member 160.

The storage guard mover 100 may include the elastic member 160 and the elastic member case 170 coupled to the bracket 60. The elastic member case 170 may be provided to accommodate the elastic member 160. The elastic member case 170 may include a first elastic member fixer 171 provided to fix one end of the elastic member 160. The other end of the elastic member 160 may be fixed to a second elastic member fixer 61 provided on the bracket 60.

The elastic member 160 may provide an elastic force to allow the storage guard 50 to be automatically pulled out. Detailed description thereof will be described later.

A plurality of sliding portions 70 may be coupled to the bracket 60. The sliding portion 70 may be provided to extend when the storage guard 50 is pulled out forward. The sliding portion 70 may have a telescopic structure.

The refrigerator 1 may include an upper support case 180 and the lower support case 190 which are provided at an upper portion of the bracket 60 and a lower portion of the bracket 60 with the bracket 60 interposed therebetween. The upper support case 180 and the lower support case 190 may be coupled to each other with the bracket 60 interposed therebetween. The upper support case 180 and the lower support case 190 may be provided to be movable relative to the bracket 60.

The upper support case 180 may include a support protrusion 181. The support protrusion 181 may be inserted into an insertion groove 51 provided in the storage guard 50. As the support protrusion 181 is inserted into the insertion groove 51, the upper support case 180 may support the storage guard 50.

The lower support case 190 may include the protrusion 191 provided to be inserted into the link hole 153 of the link 150. As the protrusion 191 is inserted into the link hole 153, the lower support case 190, and the upper support case 180 may be moved together with the link 150.

FIGS. 6 to 9 are plan views illustrating an operation of a storage guard mover in the refrigerator according to an embodiment of the disclosure.

Hereinafter an operation of the storage guide mover according to an embodiment of the disclosure will be described in details with reference to FIGS. 6 to 9.

Referring to FIGS. 6 to 9, the storage guard mover 100 may include the pusher 110 installed in the second door 40, the guide 120 installed in the first door 30, the slider 130 configured to be movable together with the guide 120 according to the movement of the guide 120, a gear 140 disposed between the guide 120 and the slider 130, and the link 150 rotatably coupled to the slider 130.

The pusher 110 may be provided to be in contact with the guide 120. As the pusher 110 is rotated, the guide 120 may be moved in the first direction or in the second direction opposite to the first direction. The first direction may represent the front of the refrigerator, and the second direction may represent the rear of the refrigerator.

The guide 120 may include a contact surface 121 provided to be in contact with the pusher 110. The contact surface 121 may be provided such that at least one part thereof always is in contact with the pusher 110.

The contact surface 121 may include a first section 122 in which the guide 120 is not moved even when the pusher 110 is rotated, and a second section 123 in which the guide 120 is moved as the pusher 110 is rotated. When viewed from the top of the refrigerator, the first section 122 may be provided in an arc of a circle, and the second section 123 may be provided in a straight line.

The guide 120 may include a first rack gear 124. The first rack gear 124 may be configured to engage with the gear 140.

The slider 130 may include a second rack gear 131. The second rack gear 131 may be configured to engage with the gear 140.

The gear 140 may include a plurality of gears. The gear 140 may include a first gear 141 configured to engage with the first rack gear 124 and a second gear 142 configured to engage with the second rack gear 131. A plurality of gears may be further provided between the first gear 141 and the second gear 142.

The gear 140 may include a pinion gear. The gear 140 may be disposed between the slider 130 and the guide 120 to transmit power. For example, when the guide 120 is moved in the first direction, the first gear 141 may be rotated counterclockwise. When the first gear 141 is rotated counterclockwise, the second gear 142 may be rotated clockwise. When the second gear 142 is rotated clockwise, the slider 130 may be moved in the second direction. Accordingly, when the guide 120 is moved in the first direction or the second direction, the gear 140 may transmit the power to the slider 130 and thus the slider 130 may be moved in the second direction or the first direction.

The link 150 may be rotatably coupled to the slider 130. The slider 130 may include a link coupler 132 configured to allow the link 150 to be rotatably coupled thereto. The link coupler 132 may include a coupling hole 133.

The link 150 may include a first shaft 151 inserted into the coupling hole 133. The first shaft 151 may protrude upward and downward of the link 150. The coupling hole 133 may be provided in pairs. The first shaft 151 may be inserted into the pair of coupling holes 133.

When the first shaft 151 is inserted into the coupling hole 133, the link 150 may be rotatably coupled to the slider 130. At this time, the link 150 may be rotatable about the first shaft 151 as the rotation axis.

The link 150 may further include a second shaft 152. The second shaft 152 may protrude upward of the link 150. The second shaft 152 may be inserted into a shaft hole 62 provided in the bracket 60. When the second shaft 152 is inserted into the shaft hole 62, the link 150 may be coupled to the bracket 60 so as to be relatively rotatable. The link 150 may be rotatable about the bracket 60 using the second shaft 152 as the rotation axis.

The first shaft 151 may be moved as the link 150 is rotated. The second shaft 152 may be fixed to at one point regardless of the rotation of the link 150.

The link 150 may include the link hole 153. The protrusion 191 of the lower support case 190 may be inserted into the link hole 153. The protrusion 191 may reciprocate in the link hole 153 when the link 150 is rotated. Particularly, the protrusion 191 may be moved from one end toward the other end of the link hole 153 when the link 150 is rotated clockwise. The protrusion 191 may be moved toward one end from the other end of the link hole 153 when the link 150 is rotated counterclockwise.

Figure 6:
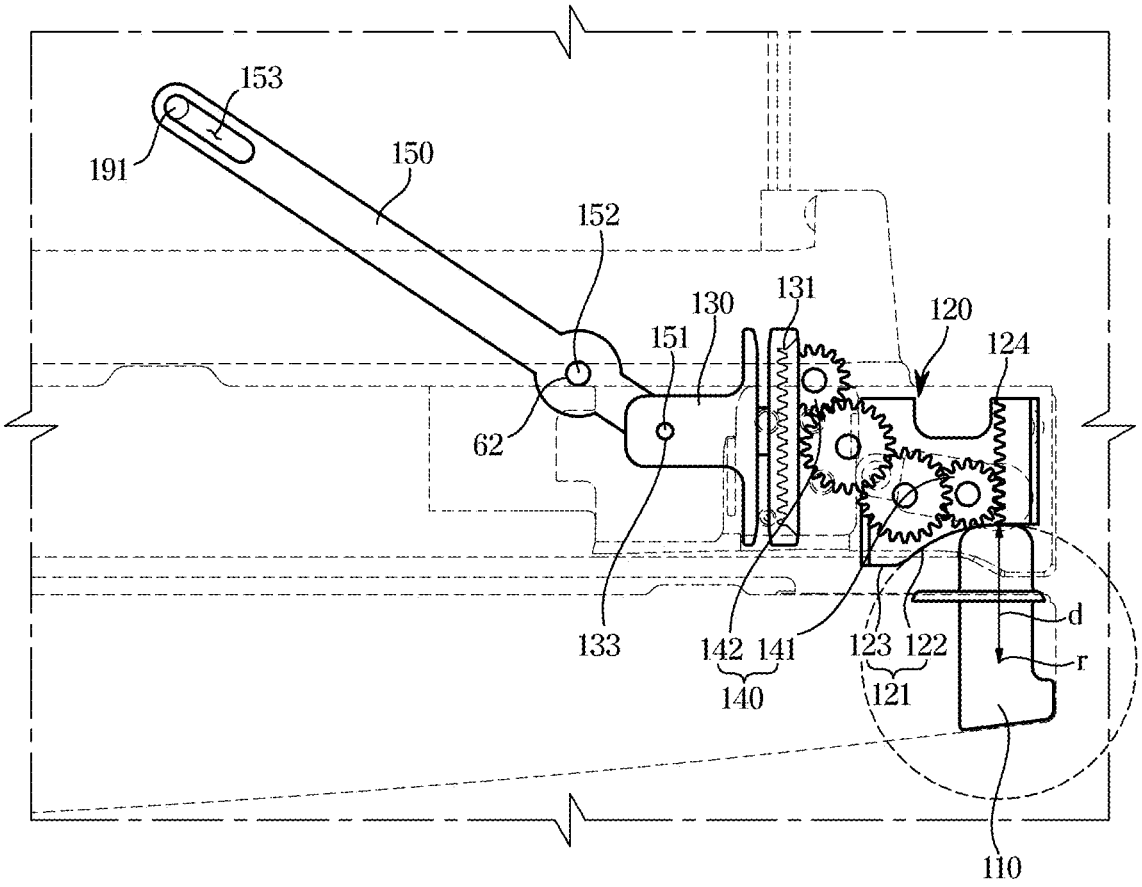
FIG. 6 is a plan view illustrating an operation of a storage guard mover in the refrigerator according to an embodiment of the disclosure.
Figure 7:
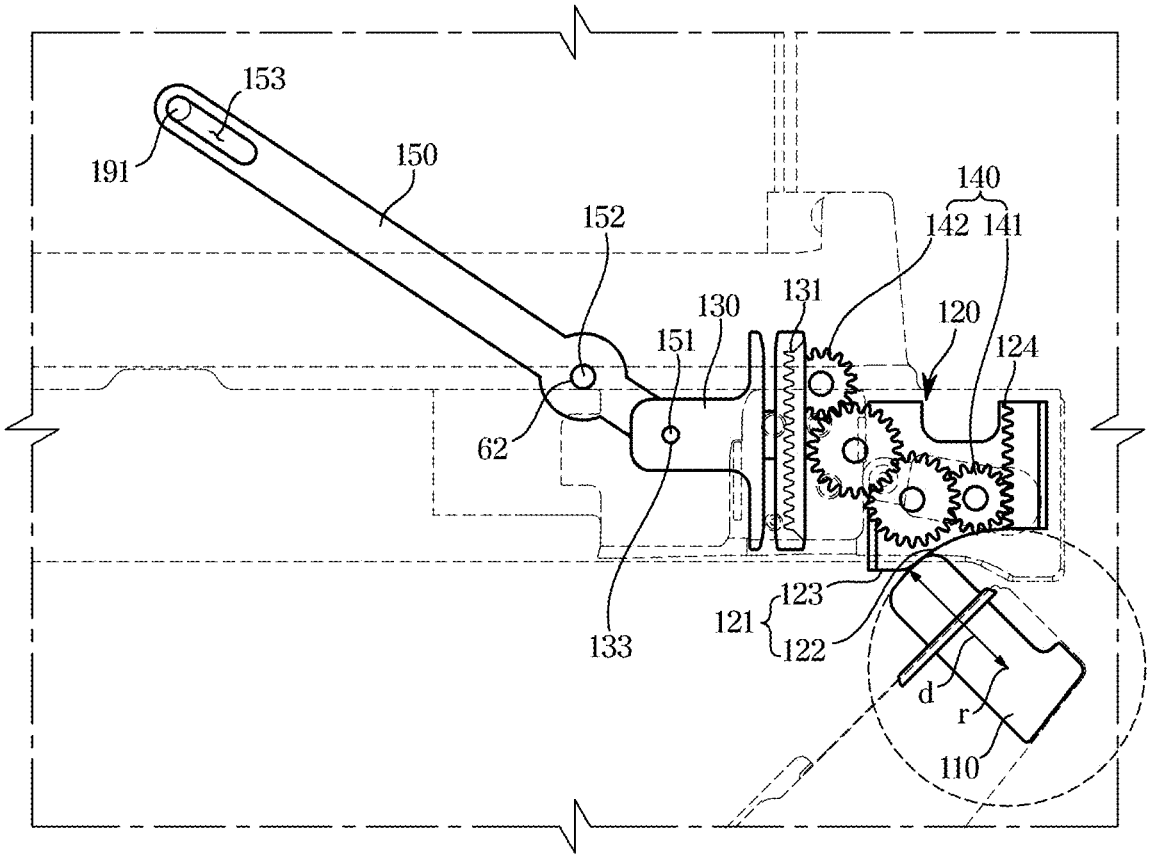
FIG. 7 is a plan view illustrating the operation of the storage guard mover in the refrigerator according to an embodiment of the disclosure.

Referring to FIGS. 6 and 7, a position of the guide 120 may be fixed even when the pusher 110 is rotated at the predetermined angle. More particularly, when the pusher 110 is rotated in the first section 122, the guide 120 may be fixed without moving in the first direction or the second direction. The first section 122 may be provided in an arc shape having a radius corresponding to a distance d from the rotation axis r of the pusher 110 to an end portion of the pusher 110. Due to this structure, even when the pusher 110 is rotated in the first section 122, the distance between the rotation axis r of the pusher 110 and the contact surface 121 may be maintained. When the distance between the rotation axis r of the pusher 110 and the contact surface 121 is maintained, the position of the guide 120 may be fixed regardless of the rotation of the pusher 110. Therefore, as illustrated in FIG. 7, when the pusher 110 is rotated at the predetermined angle, the guide 120 may not be moved. That is, the position of the guide 120 may be fixed.

Figure 8:
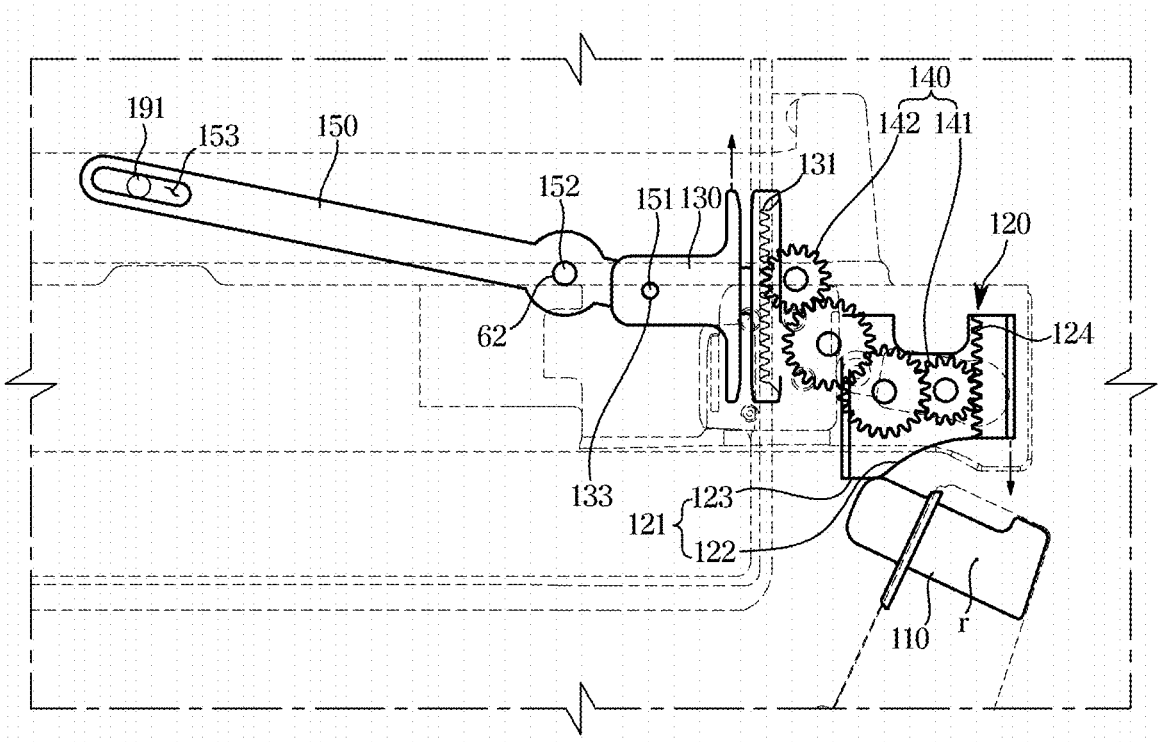
FIG. 8 is a plan view illustrating the operation of the storage guard mover in the refrigerator according to an embodiment of the disclosure.
Figure 9:
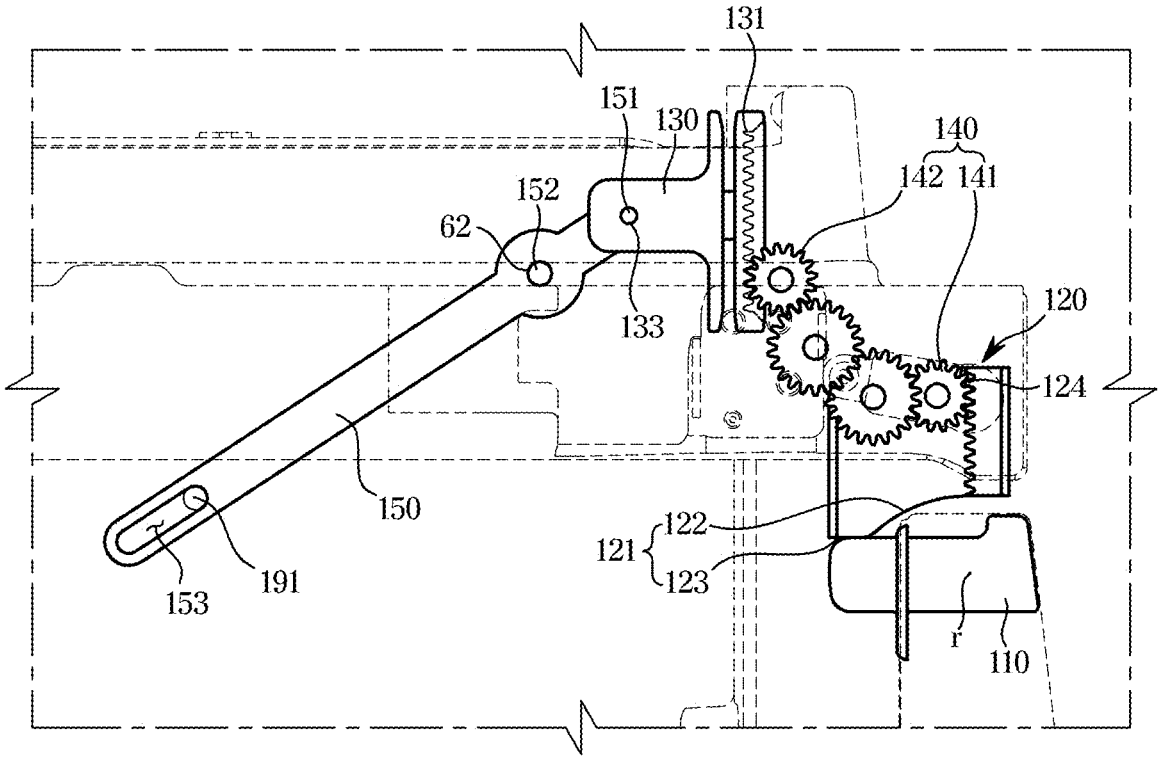
FIG. 9 is a plan view illustrating the operation of the storage guard mover in the refrigerator according to an embodiment of the disclosure.

Referring to FIGS. 8 and 9, when the pusher 110 is started to rotate over the predetermined angle, the guide 120 may be started to move in the first direction. When the pusher 110 is rotated in the second section 123, the guide 120 may be moved in the first direction according to the rotation degree of the pusher 110.

When the guide 120 is moved in the first direction, the first gear 141 may be rotated counterclockwise, the second gear 142 may be rotated clockwise, and the slider 130 may be moved in the second direction. On the contrary, when the guide 120 is moved in the second direction, the first gear 141 may be rotated clockwise, the second gear 142 may be rotated counterclockwise, and the slider 130 may be moved in the first direction.

As mentioned above, when the pusher 110 is rotated, the guide 120 may be moved, and when the guide 120 is moved, the slider guide 130 may be moved by the gear 140. When the slider 130 is moved, the link 150 may be rotated. Particularly, when the slider 130 is moved in the second direction, the link 150 may be rotated counterclockwise. When the slider 130 is moved in the first direction, the link 150 may be rotated clockwise.

When the link 150 is rotated, the lower support case 190 connected to the link 150 may be moved in the first direction or the second direction. When the lower support case 190 is moved, the upper support case 180 coupled to the lower support case 190 and the storage guard 50 coupled to the upper support case 180 may be moved. Therefore, when the link 150 is rotated, the storage guard 50 may be moved in the first direction or the second direction.

Figure 10:
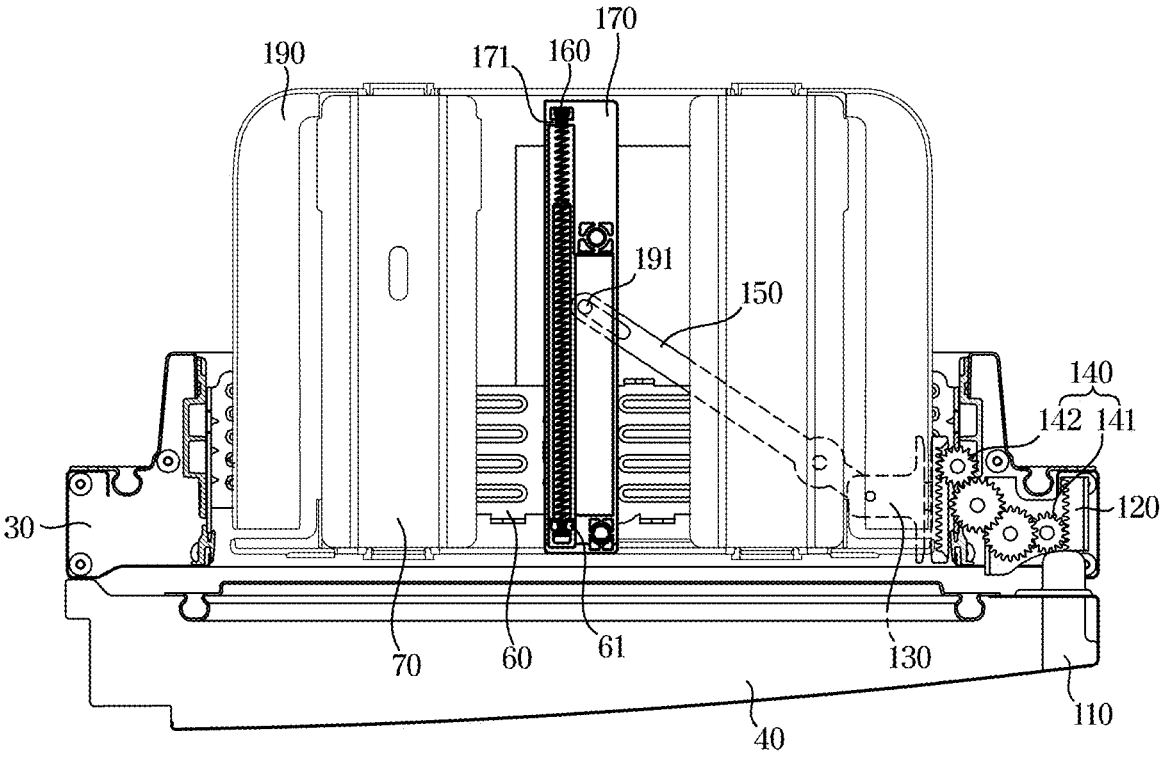
FIG. 10 is a view illustrating an operation of an elastic member when a storage guard is pulled out or inserted into in the refrigerator according to an embodiment of the disclosure.
Figure 11:
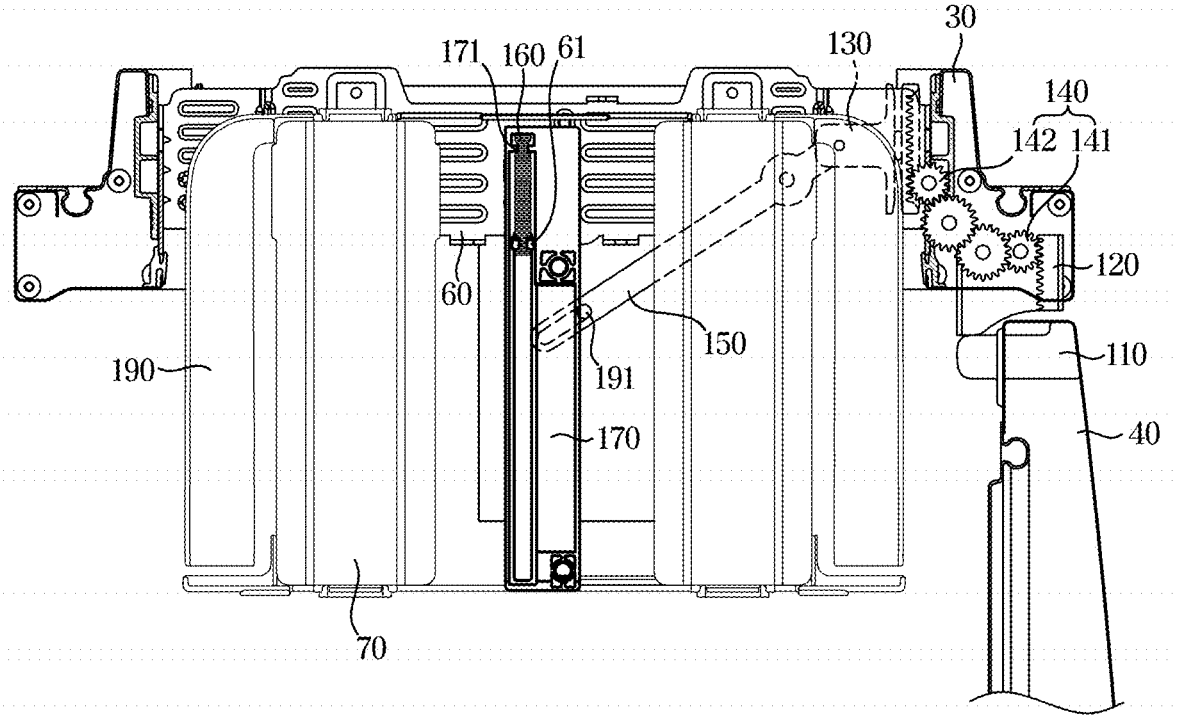
FIG. 11 is a view illustrating the operation of the elastic member when the storage guard is pulled out or inserted into in the refrigerator according to an embodiment of the disclosure.

FIGS. 10 and 11 are views illustrating an operation of an elastic member when a storage guard is pulled out or inserted into in the refrigerator according to an embodiment of the disclosure.

Hereinafter in the refrigerator according to an embodiment of the disclosure, a process of automatically pulling out and inserting the storage guard by the elastic force of the elastic member will be described in detail.

Referring to FIG. 10, the elastic member 160 may be provided to accumulate the elastic force when the second door 40 is closed. One end of the elastic member 160 may be fixed to the first elastic member fixer 171 provided in the elastic member case 170. The other end of the elastic member 160 may be fixed to the second elastic member fixer 61 provided on the bracket 60.

The elastic member 160 may include a tension spring. When the second door 40 is closed, a length of the elastic member 160 may be extended so as to accumulate the elastic force. When the second door 40 is closed, the distance between the first elastic member fixer 171 and the second elastic member fixer 61 may be extended to the maximum. The elastic member 160 may provide an elastic force in a direction in which the length of the elastic member 160 is shortened.

In order to reduce the distance between the first elastic member fixer 171 and the second elastic member fixer 61, the guide 120 may be required to be moved in the first direction. The movement of the guide 120 in the first direction may be limited by the pusher 110. Therefore, the position of the guide 120 may be fixed, and the distance between the first elastic member fixer 171 and the second elastic member fixer 61 may also be maintained. The elastic member 160 may be maintained in a state of accumulating elastic force.

Referring to FIG. 11, when the second door 40 is opened at the predetermined angle or more, the distance between the first elastic member fixer 171 and the second elastic member fixer 61 may be reduced. In other words, the elastic member 160 may provide an elastic force to move the first elastic member fixer 171 toward the second elastic member fixer 61 that is fixed. The first elastic member fixer 171 and the elastic member case 170 may be moved in the first direction by the elastic force of the elastic member 160. When the elastic member case 170 is moved in the first direction, the lower support case 190 connected to the elastic member case 170 may be moved in the first direction. When the lower support case 190 is moved in the first direction, the upper support case 180 coupled to the lower support case 190 may be moved in the first direction. When the upper support case 180 is moved in the first direction, the storage guard 50 coupled to the upper support case 180 may be moved in the first direction. That is, the storage guard 50 may be pulled out in front of of the first door 30.

In addition, when the lower support case 190 is moved in the first direction, the link 150 may be rotated counterclockwise because the protrusion 191 is inserted into the link hole 153. When the link 150 is rotated counterclockwise about the second shaft 152, the slider 130 may be moved in the second direction. When the slider 130 is moved in the second direction, the power may be transmitted through the gear 140 to allow the guide 120 to be moved in the first direction.

When the pusher 110 does not fix the position of the guide 120, the storage guard 50 may be pulled out in front of the first door 30 by the elastic force of the elastic member 160 through the above process. By the elastic force of the elastic member 160, the storage guard 50 may be automatically pulled out without an external force. In other words, when the pusher 110 is rotated in the second section 123, the guide 120 may be moved in the first direction. When the movement of the guide 120 in the first direction is allowed, the storage guard 50 may be pulled out by the elastic force of the elastic member 160 according to the above-described process.

When the second door 40 is closed, the storage guard 50 may be automatically inserted into the first door 30 through the reverse of the above process. The pusher 110 may move the guide 120 toward the second direction by a force that a user closes the second door 40, and the elastic member 160 may be tensioned to accumulate the elastic force through the reverse of the above process.

As is apparent from the above description, the refrigerator may include the storage guard mover capable of automatically pulling out or inserting the storage guard in response to opening or closing of the door.

The refrigerator may include the storage guard mover capable of pulling out the storage guard only when the door is opened at a predetermined angle or more.

The refrigerator may open and close a door and pull out and insert a storage guard without interference with each other.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a body comprising a storage compartment;

a first door arranged in front of the body and comprising an opening;

a second door arranged in front of the first door and configured to open and close the opening of the first door;

a storage guard configured to be pulled out in front of the first door and inserted into a rear of the first door, mounted to the first door; and a storage guard mover configured to pull out the storage guard to the front of the first door in response to opening of the second door at a predetermined angle or more, and configured to insert the storage guard into the rear of the first door in response to opening of the second door at an angle less than the predetermined angle, wherein the storage guard mover comprises:

a pusher provided in the second door and configured to be rotated together with the second door, and a guide configured to be moved in a first direction to pull out the storage guard from the first door or to be moved in a second direction opposite to the first direction to insert the storage guard into the first door, the guide having a fixed position when the pusher is rotated at an angle less than the predetermined angle.

2. The refrigerator of claim 1, wherein the guide comprises a contact surface provided to be in contact with the pusher, and wherein the contact surface comprises:

a first section in which a position of the guide is fixed when the pusher is rotated at an angle less than the predetermined angle; and a second section in which the guide is moved in the first direction or the second direction when the pusher is rotated at the predetermined angle or more.

3. The refrigerator of claim 2, wherein the first section comprises a curved surface having an arc of a circle, and the second section comprises a plane having a straight shape.

4. The refrigerator of claim 3, wherein the first section has an arc of a circle having a radius corresponding to a distance from a rotation axis of the pusher to an end portion of the pusher.

5. The refrigerator of claim 1, wherein the storage guard mover further comprises a slider configured to be moved in the second direction or the first direction when the guide is moved in the first direction or the second direction.

6. The refrigerator of claim 5, wherein the storage guard mover further comprises a gear disposed between the guide and the slider, and wherein when any one of the guide or the slider is moved, the gear transmits power to move the other of the guide or the slider.

7. The refrigerator of claim 6, wherein each of the guide and the slider comprises a rack gear configured to engage with the gear.

8. The refrigerator of claim 5, wherein the storage guard mover further comprises a link rotatably coupled to the slider and configured to be rotated when the slider is moved in the first direction or the second direction.

9. The refrigerator of claim 8, wherein a rotation direction of the link when the slider is moved in the first direction and a rotation direction of the link when the slider is moved in the second direction are opposite to each other.

10. The refrigerator of claim 8, wherein the storage guard mover further comprises an elastic member configured to accumulate an elastic force when the second door is closed, configured to provide the elastic force to move the slider when the second door is opened at the predetermined angle or more.

11. The refrigerator of claim 10, further comprising:

a bracket fixed to the first door to support the storage guard.

12. The refrigerator of claim 11, wherein the link further comprises a shaft corresponding to a rotation axis of the link, and wherein the shaft is connected to the bracket to be rotatable relative to the bracket.

13. The refrigerator of claim 11, wherein the storage guard mover further comprises an elastic member case in which the elastic member is placed and configured to be moved in the first direction or the second direction by the elastic force of the elastic member.

14. The refrigerator of claim 13 wherein one end of the elastic member is connected to the bracket, and another end of the elastic member is connected to the elastic member case.

15. A refrigerator comprising:

a body comprising a storage compartment;

an inner door arranged in front of the body and comprising an opening;

an outer door arranged in front of the inner door and configured to open and close the opening of the inner door;

a storage guard configured to be pulled out from the inner door in a first direction and inserted into the inner door in a second direction opposite to the first direction, and mounted to the inner door;

a pusher configured to be rotated together with the outer door;

a guide configured to be moved in the first direction or the second direction according to a rotation of the pusher;

a slider configured to be moved in the second direction or the first direction when the guide is moved in the first direction or the second direction;

a link connected to the slider so as to move the storage guard; and a gear disposed between the guide and the slider, wherein when any one of the guide or the slider is moved, the gear transmits power to move the other of the guide or the slider.

16. The refrigerator of claim 15, wherein the guide comprises a contact surface provided to be in contact with the pusher, wherein the contact surface comprises:

a first section in which a position of the guide is fixed when the pusher is rotated at an angle less than a predetermined angle; and a second section in which the guide is moved in the first direction or the second direction when the pusher is rotated at the predetermined angle or more.

17. The refrigerator of claim 16, wherein the first section has an arc of a circle having a radius corresponding to a distance from a rotation axis to an end portion of the pusher.

18. The refrigerator of claim 15, further comprising:

an elastic member configured to accumulate an elastic force when the outer door is closed, configured to provide the elastic force to move the slider to the second direction when the outer door is opened at a predetermined angle or more.

19. A refrigerator comprising:

a body comprising a storage compartment;

a door coupled to the body to open and close the storage compartment;

a storage guard arranged in the storage compartment; and a storage guard mover configured to pull out the storage guard from the storage compartment or insert the storage guard into the storage compartment in response to opening and closing of the door, wherein the storage guard mover comprises:

a pusher configured to be rotated together with the door, and a guide configured to be moved in a first direction when the door is opened and configured to be moved in a second direction opposite to the first direction when the door is closed, the guide having a fixed position when the door is rotated at an angle less than a predetermined angle from a closed state.

* * * * *